United States Patent [19]

McKenzie

[11] Patent Number: 4,607,902

[45] Date of Patent: Aug. 26, 1986

[54] ELECTRIC WIRE CONNECTOR

[76] Inventor: Thomas J. McKenzie, 6230 N. Camino Pimeria alta, Tucson, Ariz. 86718

[21] Appl. No.: 726,908

[22] Filed: Apr. 24, 1985

[51] Int. Cl.[4] ..... H01R 4/48

[52] U.S. Cl. ..... 339/61 R; 339/74 R; 339/205; 339/260

[58] Field of Search ..... 339/61 R, 61 M, 74 R, 339/204, 205, 256 R, 256 C, 256 S, 260

[56] References Cited

U.S. PATENT DOCUMENTS

| | | | |
|---|---|---|---|
| 1,212,821 | 1/1917 | Schade, Jr. | 339/260 |
| 1,657,253 | 1/1928 | Fortin | 339/256 S |
| 2,370,857 | 3/1945 | Gunzburger | 339/260 |
| 2,394,020 | 2/1946 | Soreny | 339/256 S |

FOREIGN PATENT DOCUMENTS

| | | | |
|---|---|---|---|
| 1485616 | 6/1967 | France | 339/74 R |

*Primary Examiner*—John McQuade

*Attorney, Agent, or Firm*—H. Walter Clum

[57] ABSTRACT

A connector for electrical wire conductors comprising a plurality of electrically conductive flexible spring wires assembled in a closely aligned side-by-side parallel arrangement, each wire having at least one shaped portion extending therefrom along the length thereof and cooperating with adjoining wires to form at least one channel for receiving electrical conductors to be interconnected, and a housing enclosing said assembly of wires and having openings permitting the insertion within said channel of the electrical conductors.

10 Claims, 7 Drawing Figures

ELECTRIC WIRE CONNECTOR

BACKGROUND OF INVENTION

Many patents have been directed to electrical wire conductors. This fact alone is concrete evidence of the need for a really reliable fail-safe connector wherein one can rely upon its ability to maintain permanently a faultless connection of wire conductors. It is well known that many fires have been caused by the failure of conductors which are considered safe and now in common use. The present invention was conceived and developed to overcome the faults of the prior art devices and to provide a fail-safe connector enabling the reliable interconnection of electrical conductors.

DESCRIPTION OF THE PRIOR ART

It would be difficult in the limitations of a patent application to describe the multiplicity of patented art in the wire connector field in a fruitless effort to produce a really effective fail-safe connector. However, it can safely be said that none is known at the present time that even remotely relates to the present invention wherein a plurality of individual electrically conductive wires are so formed and assembled to provide a new and fail-safe electrical wire connector.

SUMMARY OF THE INVENTION

It is the primary object of the present invention to provide an improved electrical wire connector which enables the fail-safe interconnection of electrical conductors.

Another object is to provide such a connector which is adapted for the design and construction of such connectors for use in the interconnection of specific gauges of wire conductors.

A further object is to provide a connector which is of small size, a factor particularly important in the installation of wiring circuits in building and home construction and other manufactures.

A still further object is to provide a connector which in one of its forms is so constructed that the forces against conductors inserted therein are substantially increased as they are successively inserted.

Another object of the invention is to provide a connector wherein its size may easily be determined by the gauge and electrical carrying capacity of the conductors to be interconnected by the connector.

A still further object is to provide a connector which permits the stripped ends of electrical conductors to be interconnected merely by inserting them into the connector thereby eliminating the presently common practice of using clamping devices or tools, and without twisting or bonding, thereby permitting either stranded or solid wire conductors to be interconnected with important savings in time, labor and expense, normally required by connectors now in common use.

BRIEF DESCRIPTION OF THE DRAWINGS

The foregoing and other objects and advantages of the present invention will become apparent from the following description of the accompanying drawings, in which.

DESCRIPTION OF THE PREFERRED EMBODIMENT

Figure 1:
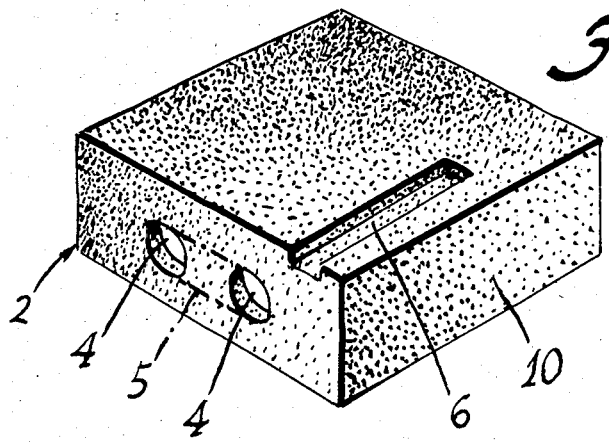
FIG. 1 is a perspective view of a connector embodying the preferred form of the invention.

First with referrence to FIG. 1, it is seen that this preferred embodiment of the invention is embodied in a housing 2 of a suitable dialectric material, such as synthetic resin. It is provided with two openings 4 along one side for the insertion of the stripped ends of conductors to be interconnected. While two openings have been shown as preferrable, only one may be provided as illustrated by the broken lines 5. As described later, other openings may be provided. A stripping guide 6 may be provided upon the surfaced of the housing to guide a user of the connector the amount of insulation to be stripped from the conductor wire ends before insertion into a particular connector.

Figure 3:
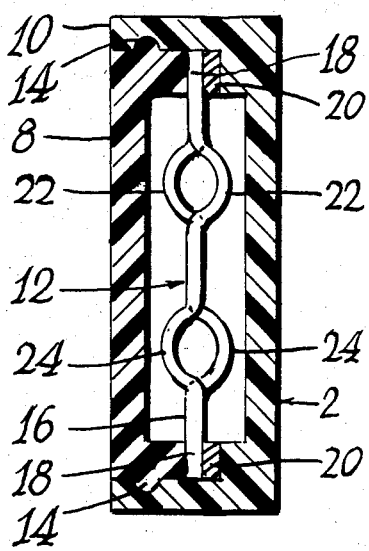
FIG. 3 is a sectional view taken along the line 3—3 on FIG. 2.

Now turning to FIG. 3 it is seen that the housing, while not to be considered so limited, is constructed of two parts 8 and 10, part 8 being telescoped into part 10 after the connector assembly 12 has been dropped into part 10. Detents 14 are provided releasably to lock the housing parts together.

The heart of both the preferred and modified forms of the invention resides in the use of a plurality of electrically interconnected individual relatively short electrically conductive flexible spring wires 16, preferrably of metal, which are in a closely aligned side-by-side, preferrably abutting, parallel arrangement one with another and provided with portions integrally formed thereon to form one or more channels for the insertion therein and interconnection of wire conductors, all enclosed in a housing having openings aligned with said channels to permit the insertion of said conductors.

Returning to FIG. 3 it is seen that the opposite ends 18 of the wires are electrically interconnected by being securely attached to some suitable means, such as the metal bars 20. This attachment may be by any suitable electrically conductive means, such as welding or soldering. Of course the use of bars 20, while preferrable, is illustrative only as other means may be used. For example, the ends may be secured toegther without the bar.

Figure 4:
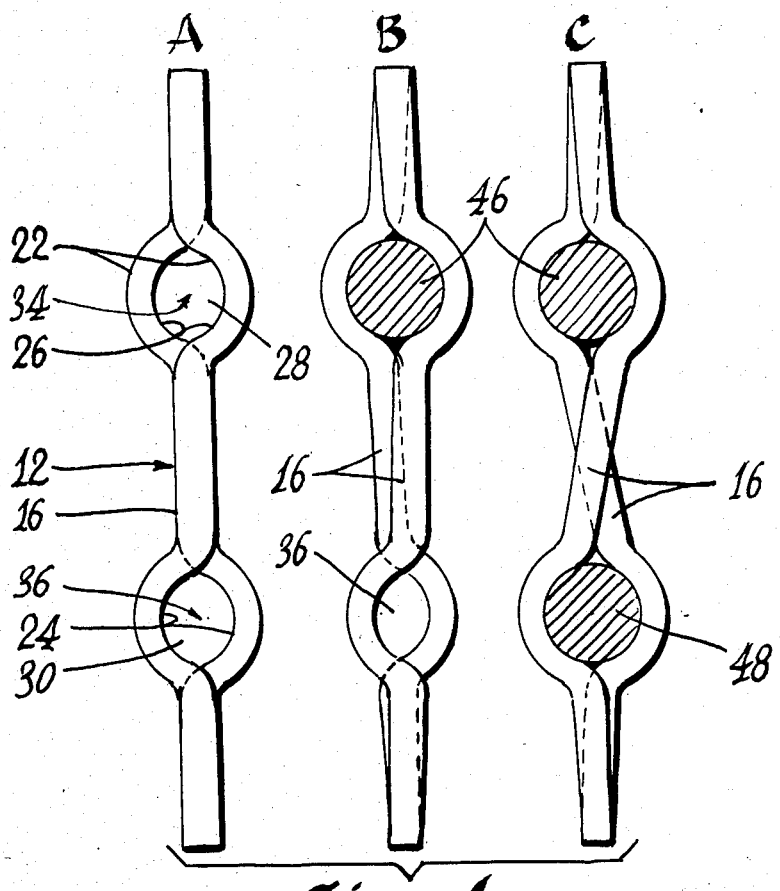
FIG. 4 (A, B and C) are somewhat diagrammatic views illustrating one important aspect of the preferred form of the invention wherein the forces upon conductors to be interconnected are increased as they are successively inserted into the channels of the conductor.

Referring now to FIGS. 4 (A, B and C), but first to 4A it will be understood in this preferred form of the invention that each wire 16 is provided along its length and spaced from each other and bars 20, not shown in this figure, with a pair of arcuately shaped upper and lower portions 22 and 24 projecting from opposite sides of the wires.

Adjoining pairs of wires 16 are arranged with the open sides 26 of the arcuate portions 22 and 24 facing toward each other thus cooperating with other adjoining pairs aligned therewith to form elongate channels which, for the purposes of description, are designated respectively as upper and lower channels 28 and 30. All of the wires 16 are similarly formed. Adjoining pairs forming the channels, as illustrated here, are formed by turning one of the wires through 180 degrees thereby presenting the arcuate portions 22 and 24 in their face-to-face attitude as illustrated.

Figure 2:
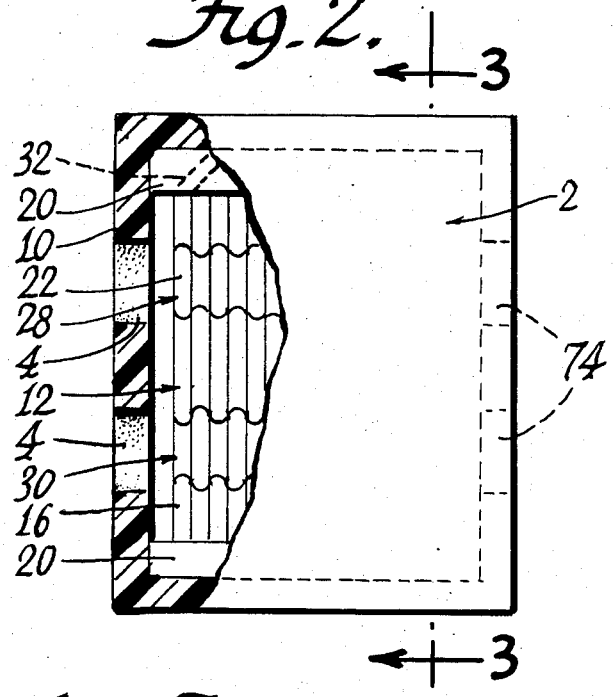
FIG. 2 is an enlarged elevational view of the connector shown in FIG. 1 with parts broken away to show its interior construction.

Prior to assembling the wires, their ends may be bent angularly in the direction of their alignment thus to facilitate their assembly by holding the wires against rotation and keeping the channel forming portions in alignment during assembly. One such bent end has been shown, by way of illustration only, at 32 on FIG. 2.

Figure 7:
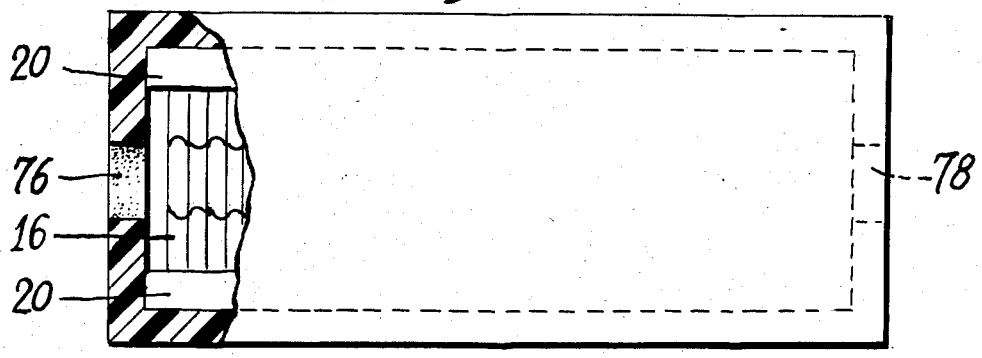
FIG. 7 is a view similar to FIG. 2 but further illustrating the modification of the invention fragmentarily shown in FIG. 5.

When assembled as described, and again with reference to FIG. 4A, the areas of separations 34 and 36 of opposing faces 26 of adjoining pairs of wires are the same but slightly less than the gauge of wire conductors for which the particular connector has been designed to accommodate, although the radii of their arcs is the same as that of the conductors. This is explained more fully with reference to FIG. 5, a greatly enlarged fragmentary view of a modification of the invention shown in FIG. 7, but showing in greater detail the arcuate construction of the wire assemblies forming the conductor receiving channels.

As illustrated in this figure, the centers 38 of the radii of each facing open side 26 of arcuate portions 22 are slightly inset from the plane of the outer edge 40 of each wire. This is shown at 42 on the top wire and at 44 on the adjoining bottom, or under wire, as illustrated. With the wires so assembled, the resultant area between the faces of adjoining wires is less than the gauge of the wire conductors to be accomodated in the channels 28 and 30, as seen in FIG. 4A.

Now returning to FIG. 4, and particularly to 4B, which shows the condition of the assembly with a wire conductor 46 inserted within the upper channel 28. Here it can be seen that the area between the upper arcuate portions of adjoining wires forming channel 28 has been increased by insertion of the conductor 46. At the same time the area of space 36 between the lower arcuate portions 24 has been decreased by the displacement of the adjoining wires 16 to the right and left between their fixed ends. When wire conductor 48 is inserted in the lower channel 30, the lower arcuate portions of this channel are spread to accomodate the conductor. Simultaneously therewith the pressure upon wire 46 is substantially increased by the opposite displacement (spreading) of the lower channel parts. However, at the same time the pressures against both wires 46 and 48 will be equalized. In practice, the grip upon both conductors 46 and 48 by the whole assembly 12 of wires 16 has rendered it extremely difficult to withdraw the wire conductors from the channels once they have been inserted.

As mentioned heretofore other openings may be provided in the housing to permit the insertion of wire conductors into the connector. Looking back to FIG. 2 and at its right side, it will be noted that two more openings are shown at 74. These may be provided in order to connect wire conductors substantially "inline", one in the top channel from one side and one in the bottom channel from the opposite side, or vice-versa. This would eliminate the necessity of splicing them together, or of using some less reliable connector.

The arcuate portions 22 and 24 of wires 16 may be constructed with larger radii on the four or five wires at the entrance throat of the channels facing the housing openings. This will provide a flare at the channel throats to facilitate the insertion of wire conductors into the channels.

The size and electrical carrying capacity of electrical conductors to be interconnected within the channels will control the structural design of each connector. It will determine the amount of surface contact needed between and the number of wires to form a particular channel. It will also control the length and depth of a connector and the construction of wires 16 for assembling a particular connector.

MODIFICATIONS

While the preferred embodiment of the invention has been described above, and is particularly useful in the interconnection of "solid" wire conductors, it will be apparent to those skilled in the connector art that certain modifications will fall within the scope of the invention. One such modification has been illustrated in FIG. 6. In this figure it is noted that the arcuate portions 50 of individual adjoining wires 52 project from the same side of the wires. While in one assembly of the wires in this modification the intermediate portions between the channel forming portions, shown in broken lines at 54, may fall in line as in the preferred embodiment, it is preferred that they, as shown at 56, project to positions close to the opposite walls 58 and 60 of the housing 62 which is constructed of a suitable electrically insulating material.

While the telescoping parts 64 and 66 of the housing may be rigid, the side walls 68, at least adjacent the wire parts 56, are flexible. The ends 70 of the wires are formed into triangular loops in which suitable means, such as metal bar 72, or other electrically conductive material, is fitted thereby electrically interconnecting the wires.

This modification of the invention is particularly useful in the interconnection of "stranded" wire conductors. In its use, pressure, by fingers, or otherwise, against the flexible side walls 68 of the housing will press the walls against the wire portions 56 and flex them toward each other thereby spreading the arcuate portions 50 of wires 52 away from each other to increase the channel areas to an extent above that of the gauge of the stranded conductors which normally are larger than the unflexed areas of the channels. After the conductors have been inserted, release of the pressure upon the housing side walls will permit the channel forming arcuate portions 50 to return toward their unflexed condition, thereby moving against and tightly gripping the wires inserted therein.

While two channels are shown in the preferred embodiment, it is, of course, obvious that more may be provided by lengthening the wires 16 and forming them with more of the arcuate portions and thereby altering their construction to accomodate more of the wire conductors to be interconnected.

By way of example only, a pair of channels, like the one shown at 28, could be provided one below the other, and a pair like the one shown at 30 could be provided below the other pair, thereby providing four channels for the interconnection of two, three or four wire conductors in the same connector. Of course, these four channels could also be arranged alternately as 28, 30, 28, 30.

Figure 6:
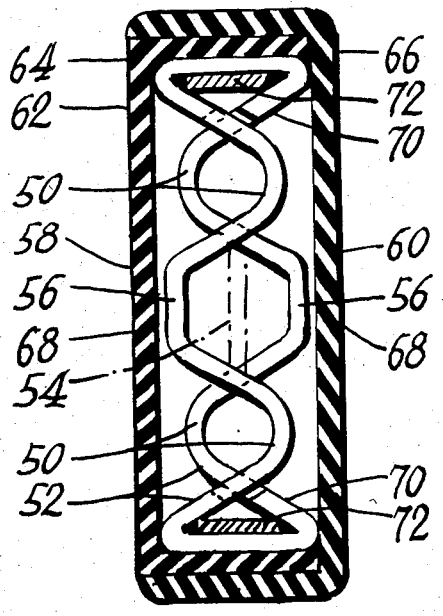
FIG. 6 is a sectional view similar to FIG. 3 but illustrating another modification of the invention.

In the modification illustrated in FIG. 6, other channels could be formed by lengthening the wires and providing more of the arcuate portions which could be on the same side of the wires or even on the opposite side. In any form of the invention, the factor controlling the number of channels to be provided and their assembly within its housing would be the number of wire conductors desired to be interconnected in the same connector.

While the channels may be designed to interconnect wire conductors of the same size (gauge), it will also be understood that they may be designed to interconnect conductors of different sizes.

Figure 5:
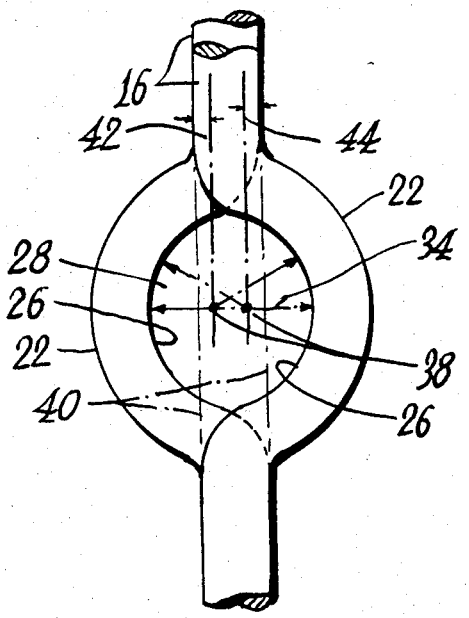
FIG. 5 is a greatly enlarged fragmentary view of one modification of the invention and illustrating details of its channel construction which are similar to other forms thereof.

Another modification, shown in FIG. 5, and for the most part described heretofore, resides in a construction wherein only one channel is provided by cooperating pairs of channel forming wires 16. In this modification, and also with referrence to FIG. 7, it is seen that only one opening 76 and 78 respectively, is provided in the opposite front and back walls thereof for the insertion therein of wire conductors to be interconnected "in-line". As in the preferred embodiment, the ends of the wires 16 preferrably will be interconnected by bars 20 positioned over and under the assembly, as shown. The housing for a particular connector embodying this modification probably, but not necessarily, would be longer and narrower from left to right as shown in this figure, than that of FIG. 2, and the quantity of channel forming wires in some cases probably would be increased, maybe even doubled.

Advantages of this form of the invention reside in the different narrow shape permitting its use where other shapes would not be feasible, and where individual conductors could be interconnected by insertion into the single channel from opposite side walls thereof for a really "in-line" connection.

Throughout the above description wire gauges have not been mentioned as they are so well known. However, it will not be amiss to mention that in the forms of the invention described herein, the wire gauges fall within thousandths of an inch and that the other dimensions of the whole assembly are correspondingly small. By way of example, the wires 16 used in one model constructed and tested, were 0.026 inches in diameter and were of a flexible spring metal, such as designated "music wire".

Considering the above description of the preferred and modified forms of the invention, it will now be clearly understood that it provides a new and different wire connector fulfilling the above and other objects thereof, as expressed in the following claims.

I claim:

1. An electrical wire connector comprising:

a plurality of similarly formed electrically conductive spring metal wires in a closely aligned arrangement one with another, each wire having portions thereof intemediate its ends designed to cooperate with adjoining similarly formed wires to form at least one elongate channel of substantially the same cross-sectional area throughout its length for receiving conductors to be interconnected;

means spaced from said channel forming portions of said wires and electrically interconnecting their ends and thereby interconnecting said similarly formed wires in permanent assembly; and a dielectric housing enclosing said assembly and having openings in line with said channel permitting the insertion of said conductors into said channel and thereby be interconnected.

2. An electrical wire connector comprising:

a plurality of electrically conductive flexible spring wires in a closely aligned parallel arrangement one with another, each wire having aligned arcuately shaped portions projecting therefrom in a direction substantially at right angles to the alignment of said wires and spaced from each other along the length thereof with said arcuate portions of adjoining pairs of wires positioned with their open sides facing toward each other thus forming channels for receiving electrical wire conductors to be interconnected, the open area of said channels normally being of slightly smaller size than the gauge of the conductors for which the particular connector has been designed to accommodate, wherein when said conductors are inserted into said channels they will spread the arcuate channel portions and be tightly gripped thereby;

means spaced from said channels electrically interconnecting the ends of and permanently joining said wires in assembly; and a dielectric housing enclosing said assembly and having at least one opening for the insertion into said channels of electrical wire conductors to be interconnected.

3. A construction according to claim 2 wherein said plurality of wires are metal and said arcuate portions of each wire extend from opposite sides thereof.

4. A connector according to claim 2 wherein said plurality of wires are metal and said arcuate portions thereof extend from the same side thereof.

5. A construction according to claim 4 wherein intermediate portions of said wires between said arcuate portions thereof extend away from the wires oppositely to said arcuate portion and in positions to be squeezed toward each other thus to increase the channel openings, and thereby permit easy insertion therein of said electrical wire conductors.

6. A construction according to claim 5 wherein said intermediate portions are arranged close to the walls of said housing, and wherein said housing walls adjacent to said intermediate portions are formed of a flexible material whereby said intermediate portions of said wires may be squeezed toward each other by pressure upon said flexible wall portions and thereby increase the channel openings for the easy insertion of said conductors.

7. A connector according to claim 2 wherein said housing includes openings on opposite walls in line with said channels thereby permitting the insertion of conductors into said channels from either or both ends of said housing for the in-line interconnection of said conductors.

8. A connector according to claim 2 wherein the radii centers of said arcuate portions are at a point inset from the edge plane of said wires and said radii are substantially the same as that of the conductors to be interconnected.

9. A connector according to claim 2 wherein said housing includes a wire stripping gauge upon its outer surface.

10. An electrical wire connector comprising:

a plurality of electrically conductive flexible spring metal wires in a closely aligned parallel arrangement one with another, each wire having an arcuately shaped portion extending therefrom in a direction substantially at right angles to the alignment of said wires and substantially midway between its spaced ends, said arcuate portion of adjoining pairs of wires being positioned with their open sides facing each other thus to form a channel for receiving wire conductors to be interconnected, the open area of said channel being slightly smaller than the gauge of the conductors for which the connector has been designed to accommodate;

means spaced from said channel electrically interconnecting the ends of said wires and permanently assembling them together; and a dielectric housing enclosing said wire assembly and having openings at opposite ends thereof in line with the channel openings whereby said conductors may be inserted into said channel from its opposite ends and be tightly gripped by the channel forming wires, and thereby be interconnected in-line.

* * * * *